US008413386B2

(12) United States Patent
Fazekas

(10) Patent No.: US 8,413,386 B2
(45) Date of Patent: Apr. 9, 2013

(54) BUILDING PROTECTION STRUCTURES AND METHODS FOR MAKING AND USING THE PROTECTION STRUCTURES

(76) Inventor: Daryl Fazekas, Los Gatos, CA (US)

( * ) Notice: Subject to any disclaimer, the term of this patent is extended or adjusted under 35 U.S.C. 154(b) by 2255 days.

(21) Appl. No.: 10/993,890

(22) Filed: Nov. 18, 2004

(65) Prior Publication Data

US 2005/0102914 A1 May 19, 2005

Related U.S. Application Data

(60) Provisional application No. 60/523,377, filed on Nov. 18, 2003.

(51) Int. Cl.
*E04D 13/15* (2006.01)
*E04D 13/14* (2006.01)

(52) U.S. Cl. ..... 52/58; 52/62; 52/74; 52/302.6; 52/716.1

(58) Field of Classification Search ..... 52/58, 62, 52/61, 73, 74, 716.1, 717.05, 287.1, 288.1, 52/302.6, 408, 95, 94, 716.2
See application file for complete search history.

(56) References Cited

U.S. PATENT DOCUMENTS

| | | | | | |
|---|---|---|---|---|---|
| 1,928,097 | A | * | 9/1933 | Fritch | 52/62 |
| 2,168,798 | A | | 8/1939 | Hirschman | 108/26 |
| 2,191,522 | A | | 2/1940 | Eckert | 108/6 |
| 2,588,011 | A | * | 3/1952 | Kersey | 52/77 |
| 2,613,404 | A | * | 10/1952 | Jones | 52/77 |
| 2,642,017 | A | * | 6/1953 | Cooper et al. | 52/16 |
| 2,663,918 | A | * | 12/1953 | Pollock | 52/76 |
| 2,664,177 | A | * | 12/1953 | Hammitt et al. | 52/92.2 |
| 2,996,843 | A | * | 8/1961 | Mack | 156/71 |
| 3,100,012 | A | * | 8/1963 | Dunn | 160/89 |
| 3,156,070 | A | * | 11/1964 | Mesnager | 52/18 |
| 3,262,236 | A | * | 7/1966 | Poyer | 52/58 |
| 3,323,261 | A | * | 6/1967 | Richardson | 52/92.1 |
| 3,423,889 | A | * | 1/1969 | Elconin | 52/58 |
| 3,566,554 | A | * | 3/1971 | Schaffer et al. | 52/64 |
| 3,585,766 | A | | 6/1971 | Jamieson | 52/60 |
| 3,807,103 | A | * | 4/1974 | Kautz et al. | 52/58 |
| 3,905,165 | A | * | 9/1975 | Kneisel | 52/58 |
| 3,911,633 | A | * | 10/1975 | Bamberger | 52/75 |
| 3,958,373 | A | * | 5/1976 | Stewart et al. | 52/58 |
| 4,077,171 | A | | 3/1978 | Simpson et al. | 52/96 |

(Continued)

FOREIGN PATENT DOCUMENTS

| | | | | |
|---|---|---|---|---|
| GB | 2215359 | * | 9/1989 | 52/58 |
| JP | 4-20644 | * | 1/1992 | 52/58 |
| JP | 6-200589 | * | 7/1994 | 52/58 |

OTHER PUBLICATIONS

"*A Watertight Second-Story Porch*", G. Burr, Oct./Nov. 2004, Fine Home Building, No. 166, pp. 89-93, The Taunton Press, www.finehomebuilding.com.

*Primary Examiner* — Phi Dieu Tran A
(74) *Attorney, Agent, or Firm* — Martine Penilla Group, LLP

(57) ABSTRACT

A structure and method for making a structure for use in building construction is provided. The structure is defined by a body having a top surface, a bottom surface, and side surfaces. A flashing liner is integrally formed with the body, and the flashing liner is defined at one or more of the side surfaces of the body. The body is capable of being attached to a building structure, and the flashing liner provides a weather interface with the building structure.

19 Claims, 20 Drawing Sheets

U.S. PATENT DOCUMENTS

| | | | | | |
|---|---|---|---|---|---|
| 4,249,273 | A | * | 2/1981 | Jakowicki | 4/494 |
| 4,359,845 | A | * | 11/1982 | Harrison | 52/169.6 |
| 4,527,368 | A | * | 7/1985 | Jentoft | 52/200 |
| 4,741,132 | A | | 5/1988 | Emblin | 52/58 |
| 4,742,654 | A | * | 5/1988 | Cole | 52/97 |
| 4,848,049 | A | * | 7/1989 | Hanson | 52/97 |
| 4,932,171 | A | * | 6/1990 | Beattie | 52/58 |
| 5,148,644 | A | * | 9/1992 | Weir | 52/300 |
| 5,740,647 | A | | 4/1998 | Kelly | 52/408 |
| 5,950,377 | A | | 9/1999 | Yoder | 52/177 |
| 6,088,992 | A | | 7/2000 | Nunley | 52/783.19 |
| 6,185,885 | B1 | | 2/2001 | Thaler | 52/219 |
| 6,189,279 | B1 | * | 2/2001 | Fiechtl | 52/403.1 |
| 6,233,886 | B1 | | 5/2001 | Andres | 52/177 |
| 6,725,617 | B2 | | 4/2004 | Cox | 52/408 |

* cited by examiner

FIG. 8
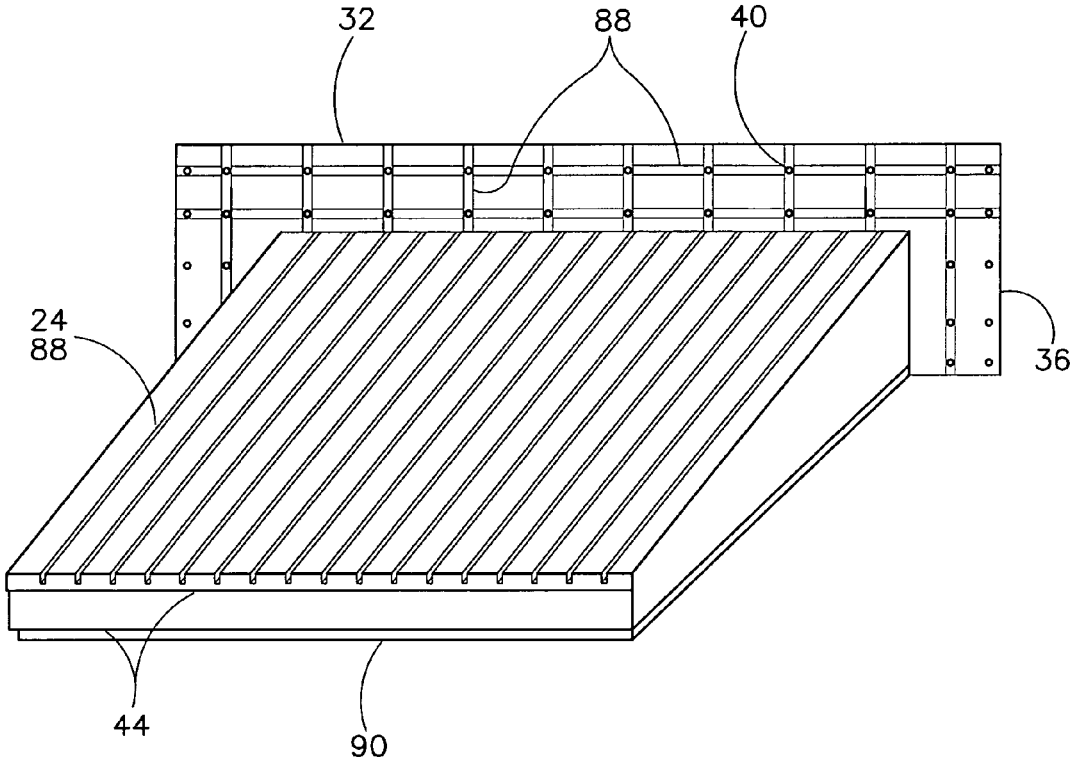
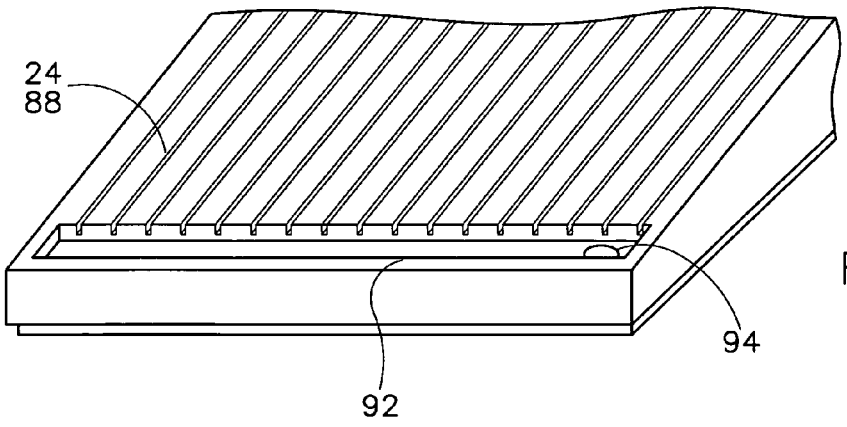
FIG. 9

BUILDING PROTECTION STRUCTURES AND METHODS FOR MAKING AND USING THE PROTECTION STRUCTURES

This Patent Application claims priority from U.S. Provisional Patent Application No. 60/523,377, filed on Nov. 18, 2003, and entitled "Building Protection Structures and Methods for Making and Using the Protection Structures." The contents of this provisional application are hereby incorporated by reference.

BACKGROUND OF THE INVENTION

1. Field of the Invention

This invention relates generally to form molded structures, and more particularly, to the manufacturer, installation and use of molded building component structures.

2. Description of the Related Art

In current construction practice, there are two known and common methods of building outdoor decks and balconies, to be used as part of building structure. The first is the classic redwood deck, which allows rain water to leak down between gaps in the planks. The second is the moisture resistant tile or liquid plastic coating deck.

Most people are familiar with redwood decks. Floor joists are attached to the house either cantilevered from the second floor, or built on beams and posts for a larger deck. The 2×6 (inch) dimensional redwood boards are nailed down flat perpendicular to the joists with a ¼ inch gap between the planks. This has been a very popular and attractive decking system.

One downside to this system is that redwood cracks and ages, and redwood is becoming more scarce and expensive. Recently, firms like Trex™ have addressed these problems by extruding synthetic decking planks, that are similar in shape and size to the redwood 2×6 planks. They can be sawed and drilled almost as easily as wood. By mixing plastic and sawdust these products are longer lasting than redwood, wear and look better than redwood over the years and claim to be termite and mold resistant.

The problem that both redwood and synthetic wood decks have is that they are not rain-proof. When it rains, the water drops down between the gaps of the boards, hitting the ground below and wetting the joists and beams. Over time this rots the structural wood, eventually requiring rebuilding of the deck, or worse, complete structural collapse, killing in many cases those on the deck at the time.

The other drawback is that no habitable space can be built below. A watertight decking system is required for this application. There has been a long history of watertight decks and balconies built over the years. The most common way is to build a slightly sloping hot mopped deck using modified bitumen and galvanized metal flashings, much the same way a flat roof is done by roofing contractors. The difference is that a walking deck must be built much stronger than a roof, and must have a hard, slip resistant surface over the asphalt coating. Typically this is done like a tile shower pan. Over the hot mop, ¾' of grout is placed, properly sloped for drainage, then tile or stone or pavers are set, then grouted, and finally weather sealed. Finally flashing must be installed and checked to avoid leaks into the house during rain storms.

The hot mopped and tiled exterior rain resistant deck is a very expensive and complex endeavor, involving 4 or 5 building trades, spending weeks on each deck. And worse, the deck is the most vulnerable part of the house to the freeze thaw cycle, the expansion and contraction between hot and cold weather. During hot weather the deck may expand cracking the asphalt coating underneath which may have become brittle over time. In the cold weather the tiles may pull away from the house, allowing water infiltration. Then when it rains, water may seep below the tile and migrate to some other location where the asphalt is cracked, causing leaks down into the sheet rock ceiling below.

When the homeowner calls out the contractor it generally happens that the real point of leakage is hidden from view from the deck above. Many times the only fix is to tear up the expensive tile and hot mop and do it all again.

In part to address this problem of the invisible leak, as well as the high cost of the installation of rain-proof decks, many liquid epoxy and plastic walkable coatings have been developed over the past 20 years. Firms like Dex-O-Tex sell liquid coatings installed by factory-approved installers, in several coats and with special flashings and fiberglass reinforcing. A sand finish is tossed onto the final coat for skid resistance, and different colors are offered. Durability depends on the sloping and structural strength of the exterior grade plywood on which the liquid coats are spread. A 5-coat job may take a week to complete and is still a relatively expensive and risky endeavor. These have also been leaks and liability problems in housing projects. The deck must be inspected regularly and repaired promptly to protect the habitable areas below.

Therefore, what is need is a durable and reliable structure that can be used as a deck or building component, without introducing the aforementioned problems.

SUMMARY OF THE INVENTION

Broadly speaking, the present invention fills these needs by providing a structure that is form-molded, in one piece. The form-molded structure can take on any number of forms, as will be described below. One particular form is the form of a deck of a building. The resulting deck is defined from plastic, and when formed, defines a plastic deck shell with integral flashing. The deck shell can be installed over or up against structural framing of a building to provide moisture protection and enable human traffic, if the form is a deck. It should be appreciated that the present invention can be implemented in numerous ways, including as a method, a structure, a system, or an article of manufacturer. Several inventive embodiments of the present invention are described below.

In accordance with a first aspect of the present invention, a structure for use in building construction is provided. The structure is defined by a body having a top surface, a bottom surface, and side surfaces. A flashing liner is integrally formed with the body, and the flashing liner is defined at one or more of the side surfaces of the body. The body is capable of being attached to a building structure, and the flashing liner provides a weather interface with the building structure.

In accordance with a second aspect of the present invention, a deck structure to be attached to a building is provided. The deck structure has a grooved top surface, a bottom surface, and side surfaces, and the deck structure is defined from a plastic mold. A flashing liner is integrally formed from the plastic mold along with the deck structure, and the flashing liner and the deck structure define a unitary structure without connecting seams. The flashing liner is defined at one or more of the side surfaces of the deck structure. The body is capable of being attached to the building, and the flashing liner provides a weather interface with the building and the top surface providing a supporting interface for human support and traverse when the deck structure is attached to the building.

In accordance with a third aspect of the present invention, a deck structure to be attached to a building is provided. The deck structure has a rough top surface, a bottom surface, and side surfaces, and the deck structure is defined from a plastic mold. A flashing liner is integrally formed from the plastic mold along with the deck structure, and the flashing liner and the deck structure define a unitary structure without connecting seams. The flashing liner is defined at one or more of the side surfaces of the deck structure, and the flashing liner is configured as an interface with the building at one of a wall or a door way of the building. The flashing liner establishing a weather tight interface between the wall or the door way of the building, and the rough top surface having grooves defined by the plastic mold. The grooves extend substantially perpendicularly away from the building, such that the grooves drive water away from the building.

In accordance with a fourth aspect of the present invention, a method for making building structure is provided. The method includes defining a mold. The mold having surfaces for defining a body with a top surface, a bottom, and side surfaces, and the mold further including surfaces for defining flashing liners to be coupled to at least one of the side surfaces of the body. The method then includes filling the mold with a plastic to define a deck structure with integral flashing. The deck structure defined for supporting a human when the deck structure is attached to a building.

In one embodiment, the deck is formed in the factory to the size and shape desired by the customer, and includes integral flashing, water run-off channels and a non-skid walking surface. The deck of the present invention provides a cost effective, easy and fail-safe method of installing moisture resistant decking surfaces in residential or commercial construction projects. In one embodiment, the process of making the one piece deck utilizes vacuum-formed technology, which allows the deck to be made as a seamless unitary and integral structure. The integral structure, in the decking application, will include integral flashing. The deck therefore installs easily and quickly to provide rain tight protection to structural wood and habitable space below and around the deck.

By using tough and flexible polyethylene plastic, ribbed for strength and surfaced for a skid resistance, a strong and nearly indestructible walking surface is provided. By including integral flashing down over the sides of the deck and up under the building paper and stucco, leaks are eliminated. By design, potential weak spots are strengthened, and expansion and/or contraction is anticipated and allowed. The deck surface can move back and forth through temperature and humidity swings, or earthquakes.

As a benefit, due to the single piece design, installation can be done in as little as one half hour per deck. This is compared to over a week for all other rain proof systems. In some markets, total material and labor cost can be as low as 10% of what is currently paid for prior art, less desirable techniques. Further, once a carpenter builds the structural deck and covers the joists with plywood, he can immediately cover the deck with a white neoprene foam, staple building paper to the lower walls, nail on the 1×2 cleats and then screw on the Deck with stainless steel screws and washers, and then tap in the plastic screw cover plugs. Compare to hot mop decks, after the carpenter frames the deck, the following sub-contractors are required: a. roofing/hot mop sub; b. sheet metal flashing sub; c. tile setter; d. sealer/painter; and e. more flashing. Liquid plastic decking subs handle most flashing themselves but the sheet metal sub usually is involved. By design, stops and guides allow the carpenter to install the deck in only one way—the right way. Should the carpenter forget a piece of building paper, he can unscrew a section until he can slip the paper in, then re-screw.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

FIGS. 8 and 9 illustrate an awning with integral flashing, in accordance with one embodiment of the present invention.

DETAILED DESCRIPTION OF THE PREFERRED EMBODIMENTS

An invention is described for plastic form molded structures, which can be used in the construction of buildings. The structures can take on any number of forms, and examples of such forms are provided below. Of particular interest, a deck can be defined from a single plastic piece with integral flashing. In one example, the deck is formed in a mold which is filed with liquid plastic, and the liquid plastic is cured or allowed to cool until a hard material results. The plastic can optionally include fibers to introduce strength, and colors can be added to provide different ready to use styles. It will be obvious, however, to one skilled in the art, that the present invention may be practiced without some or all of these specific details. In other instances, well known process operations have not been described in detail in order not to unnecessarily obscure the present invention.

A deck system is a one piece molded plastic unit. In one embodiment, the decking surface curves up the wall and becomes flashing. The flashing is thus integral with the deck body. At a sliding door or French doors, the flashings bend down under the door sill, preventing driving rains from soaking the carpet or wood framing. The plastic used is similar to that used in pickup truck bed liners, many of which have suffered 20 years of abuse (like daily loading and unloading of bricks) in the desert sun without cracking or denting. In one specific example, the plastic material will include fibers to introduce additional strength. Examples of the plastics, without limitation, can be selected from the group consisting of one or a combination of (a) polyethylene, (b) olefin (c) olefin fibers (d) polypropylene and polyethylene, (e) polystyrene, (f) poly (vinyl chloride), and (g) polytetrafluoroethylene.

In another alternative and optional embodiment, supporting framing may also be embedded in a mold so that the resulting molded plastic can have additional strength.

Slotted screw holes and the inherent flexibility of the plastic make it impervious to expansion, contraction and structural movement. Ample flashing wings are designed for horizontal rains. Radiant heat can be resisted by a light gray color of the plastic, the white painted underside and the white neoprene under-layment. Direct sunlight has no deterioration effect, chemicals or animal urine will not damage surface, and moist or salt air will not damage the plastic or the stainless steel screws. In sum, the resulting form molded deck or other structure, is capable of withstanding harsh outdoor weather elements, while maintaining its serviceability to the structure.

Figure 1:
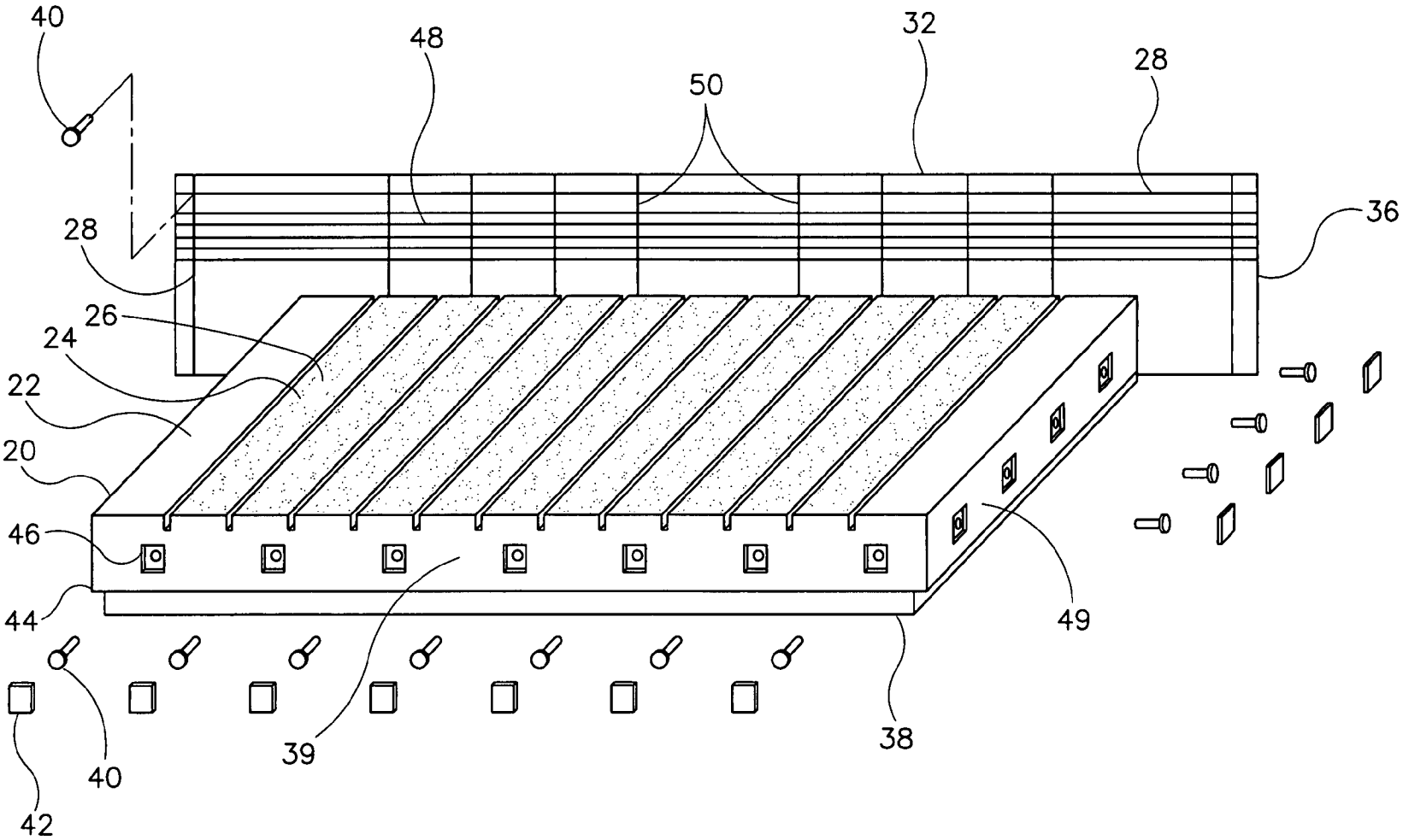
FIG. 1 is a perspective view of a cantilever deck, in accordance with one embodiment of the present invention.

FIG. 1 is a perspective view of a cantilever deck, in accordance with one embodiment of the present invention. Made from a single piece of plastic, it is heat formed to the shape shown. The heat is used to melt the plastic used to define the deck, and the plastic is applied to a mold. The molding process can include, for example, a vacuum molded process, a form molded process, a pressure form molded process, or an injection molded process. In essence, the molding process can vary, so long as the mold can receive liquefied plastic, allow the plastic to flow into the appropriate shape, and then allow the plastic to cool until reaching a solid state.

In the illustrated example, the deck 20 has a slightly sloping flat surface, sloping about 2% from back to front. Of course, the slope is optional depending on the application. The flat areas at the left and right are the guard railing attachment areas. The drainage grooves 24 also slope back to front and also act as structural ribs spaced inches apart, giving the roughen walking surface 26 strength and the ability to span imperfections in the plywood structural wood surface below. The ribs prevent buckling and tie the entire unit together.

Sloping up from the back of the walking surface 26 is the back flashing 32 and to the right and left sides are the side flashings 36. The flashings 32/36 facing forward have embedded grooves to define screw guide grooves 28. The screw guide grooves 28 let the carpenter or installer know where to place the attachment screws 40, as well as to help the screw tap into the plastic by starting it in the groove without slipping off the plastic. The screw will not be placed too close to the edge where it might break the plastic. The vertical cut guide grooves 30 in the back flashing 32 are placed to assist the installer in making the vertical cuts needed to install the patio doors and fold back that portion of the back flashing 32. The grooves are placed at the rough opening widths of common patio doors. The grooves aids the use of a utility knife by providing a scored vertical line. The other horizontal grooves are the bending grooves 48 used when that portion of the back flashing 32 is bent back into the patio door opening. Reference should be made to the description of FIG. 3 for more information.

In the front apron 39 and the side aprons 49, are screw hole recesses 46 which have slotted expansion holes inside. After installing the stainless steel screws 40 and washers provided, screw cap plugs 42 are tapped into the recesses 46. The caps keep water out and visually hide the screws. Drip ledges 44 are designed to keep rain water away from the structure below. Gutters, stucco or wood trim can be installed by the contractor in the space provided beneath the bottom flashing 38.

Figure 2:
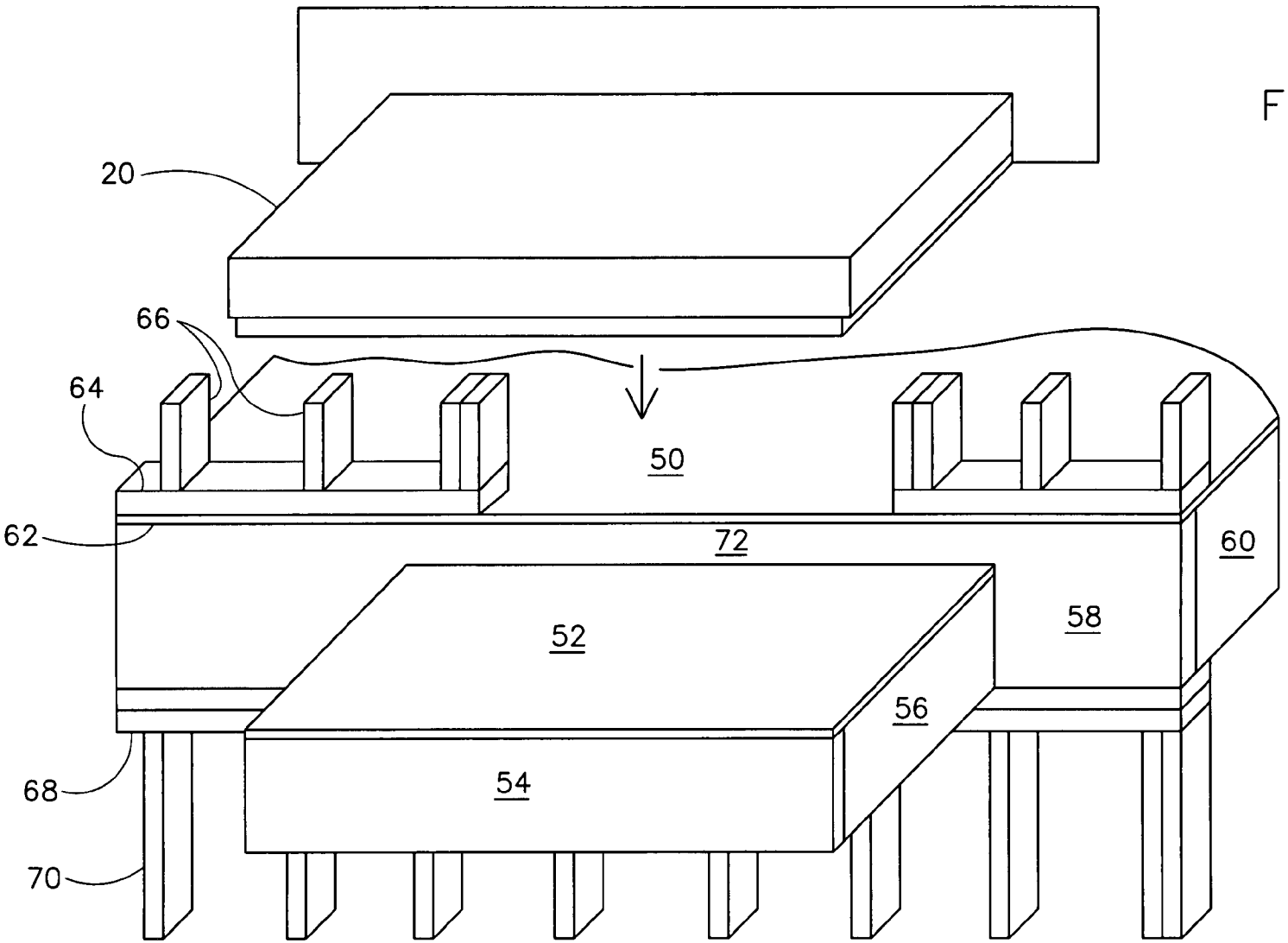
FIG. 2 is an exploded view of the deck to be attached to a building, in accordance with one embodiment of the present invention.
Figure 3A:
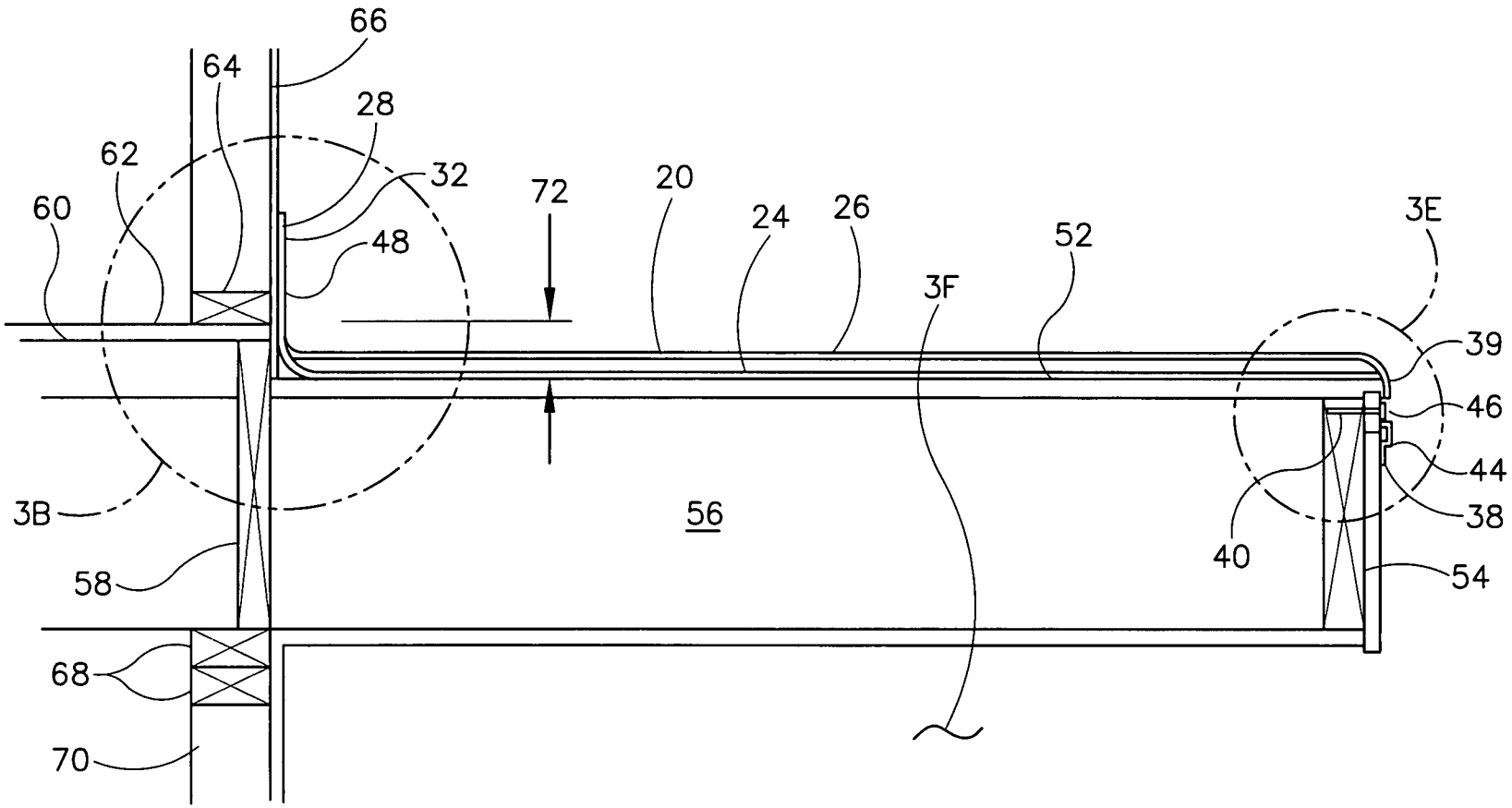
FIGS. 3A-3I show the deck attached to a building and integral flashing installed up against the building and detailed magnifications, in accordance with one embodiment of the present invention.
Figure 3B:
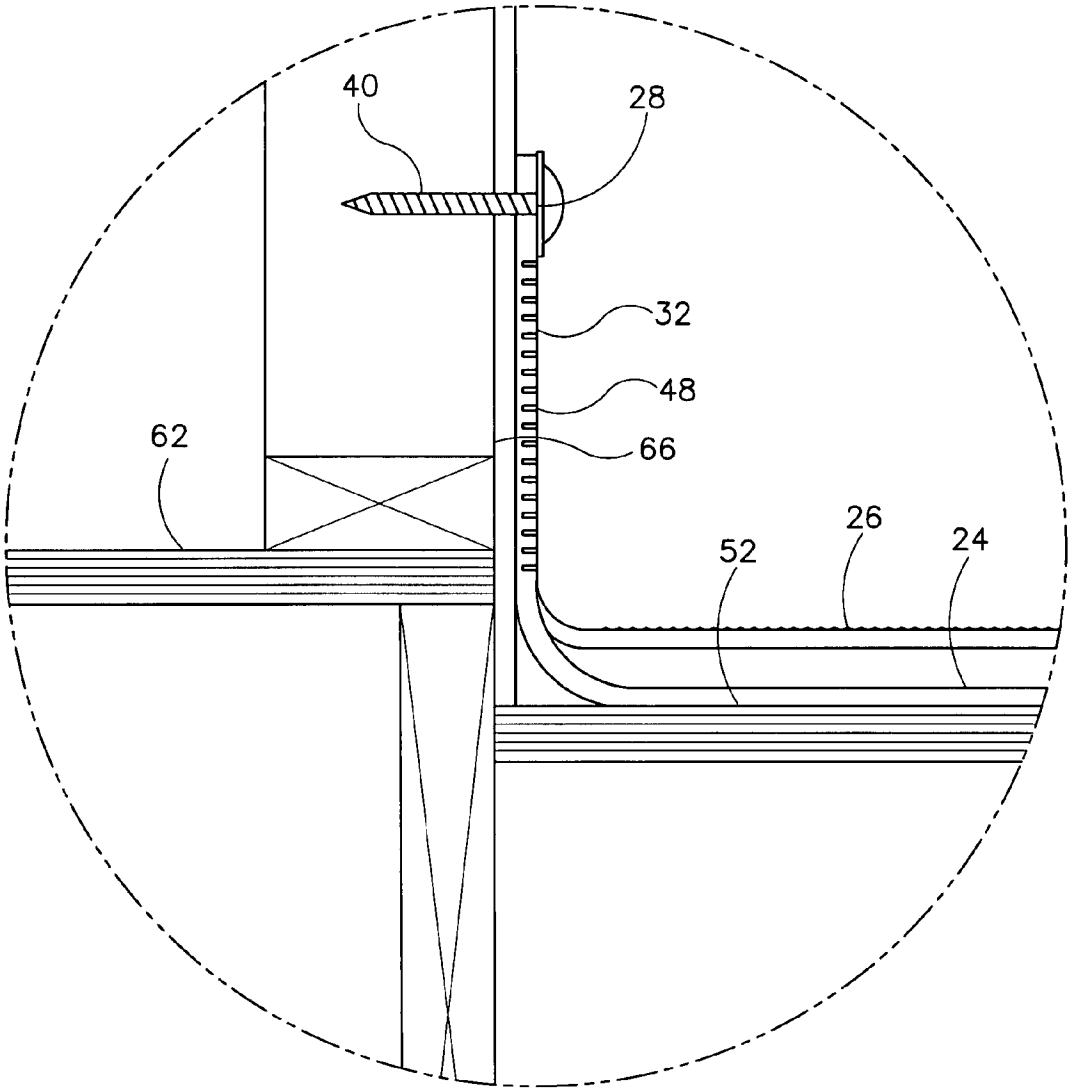
Figure 3C:
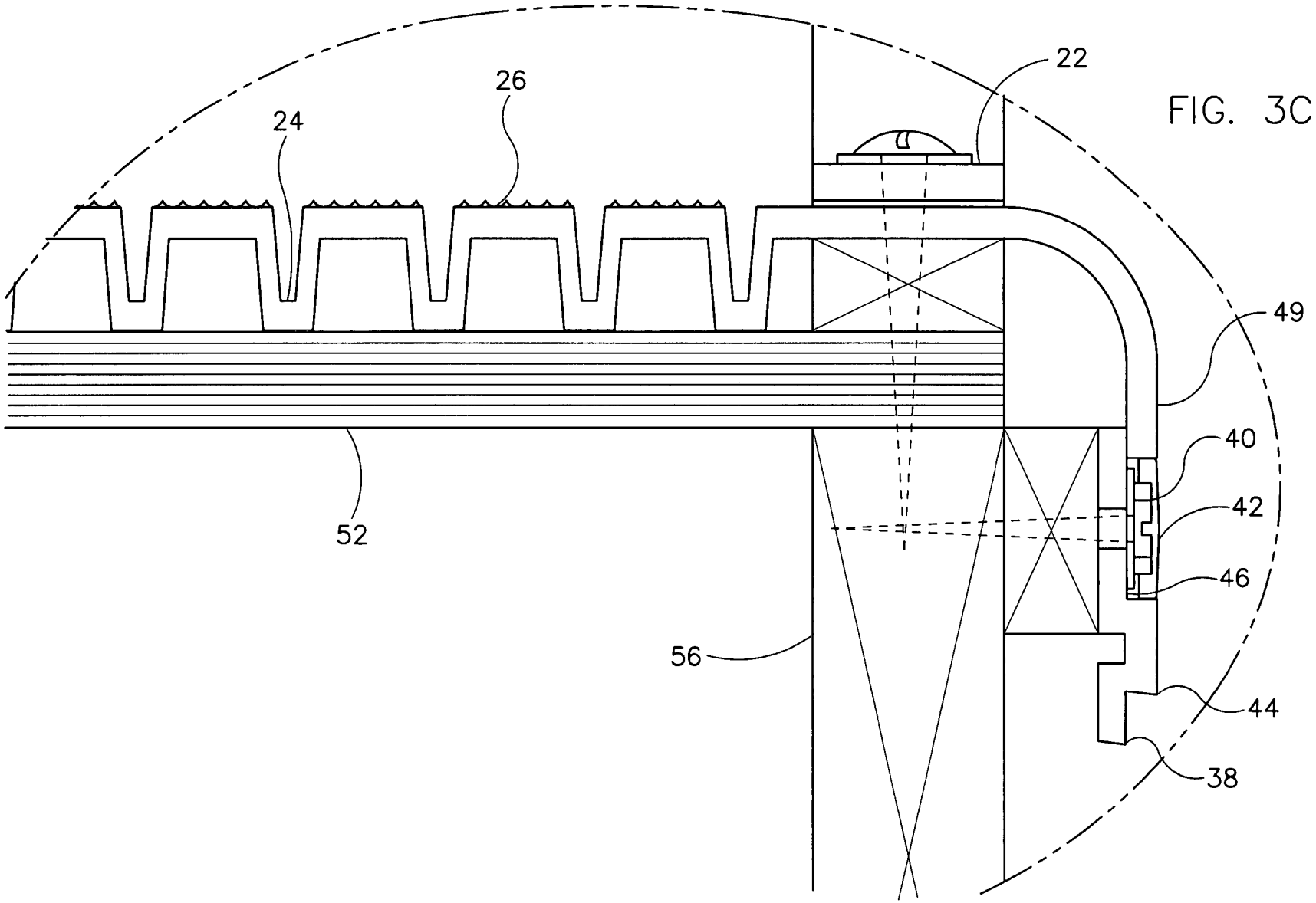
Figure 3D:
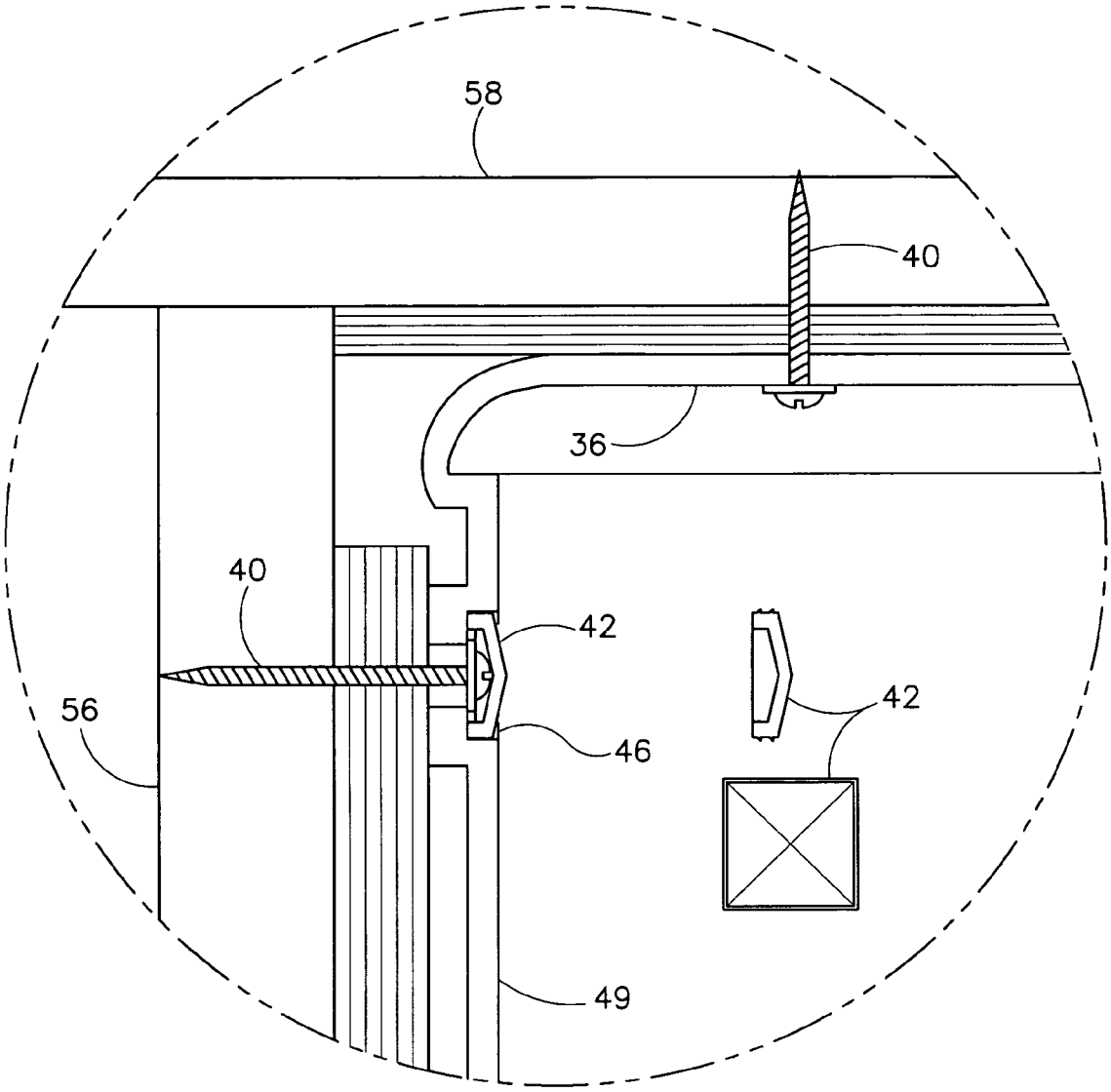
Figure 3E:
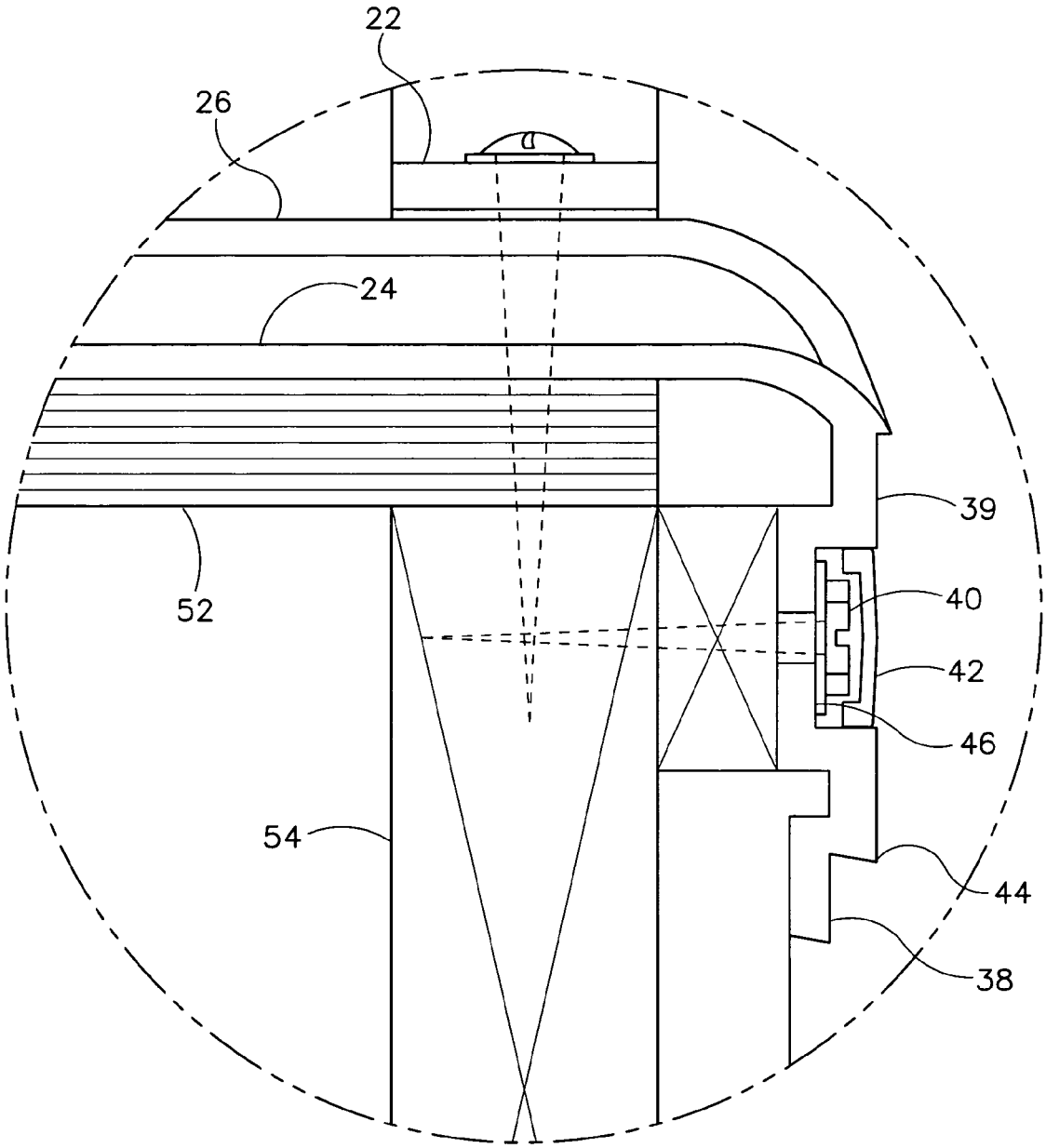
Figure 3F:
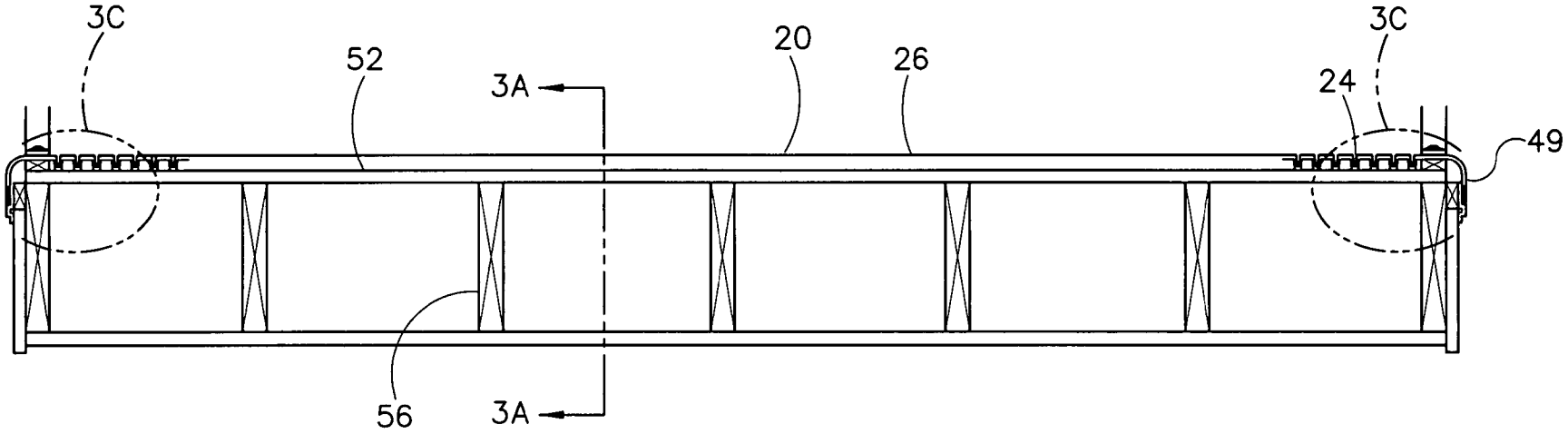
Figure 3G:
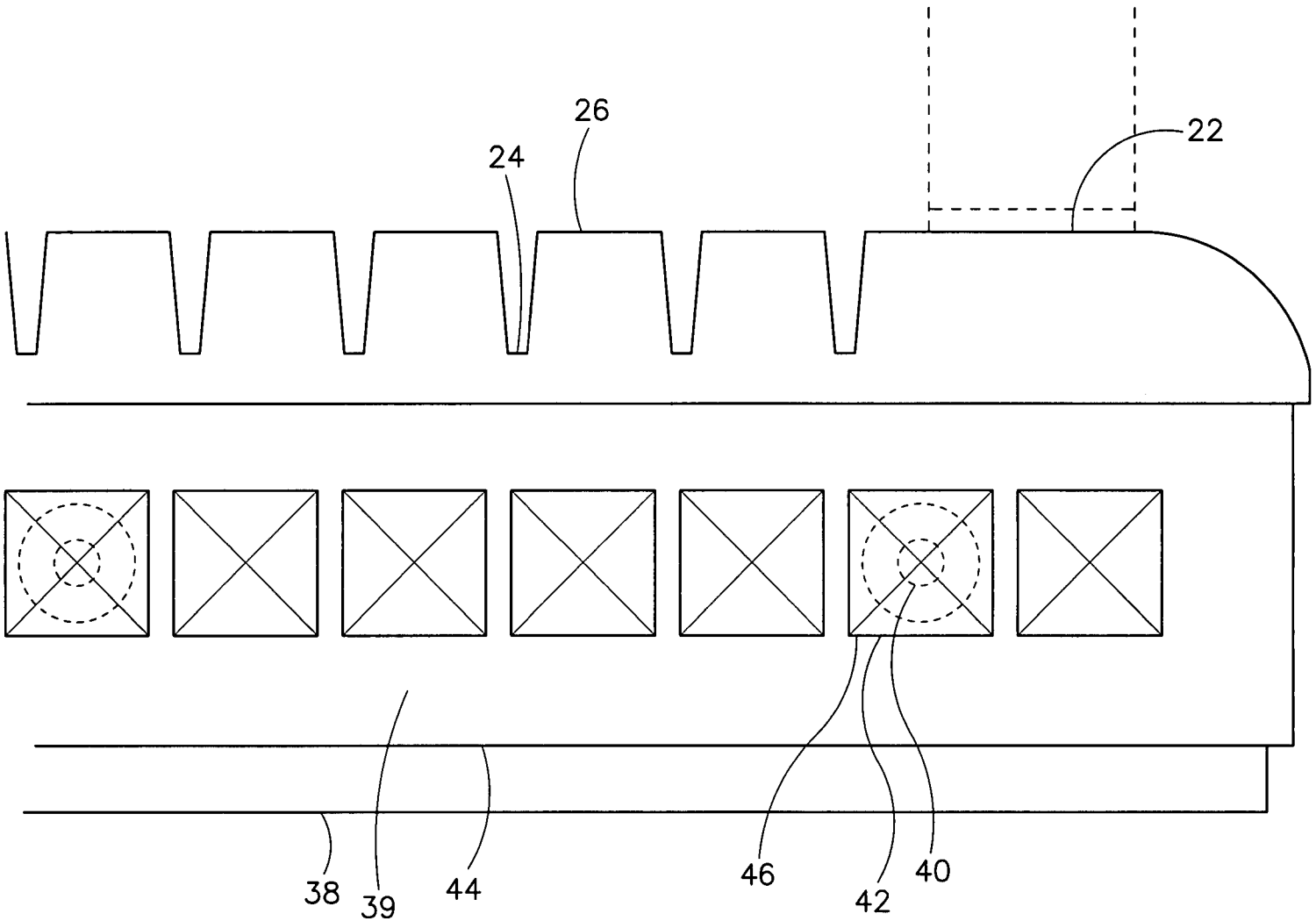
Figure 3H:
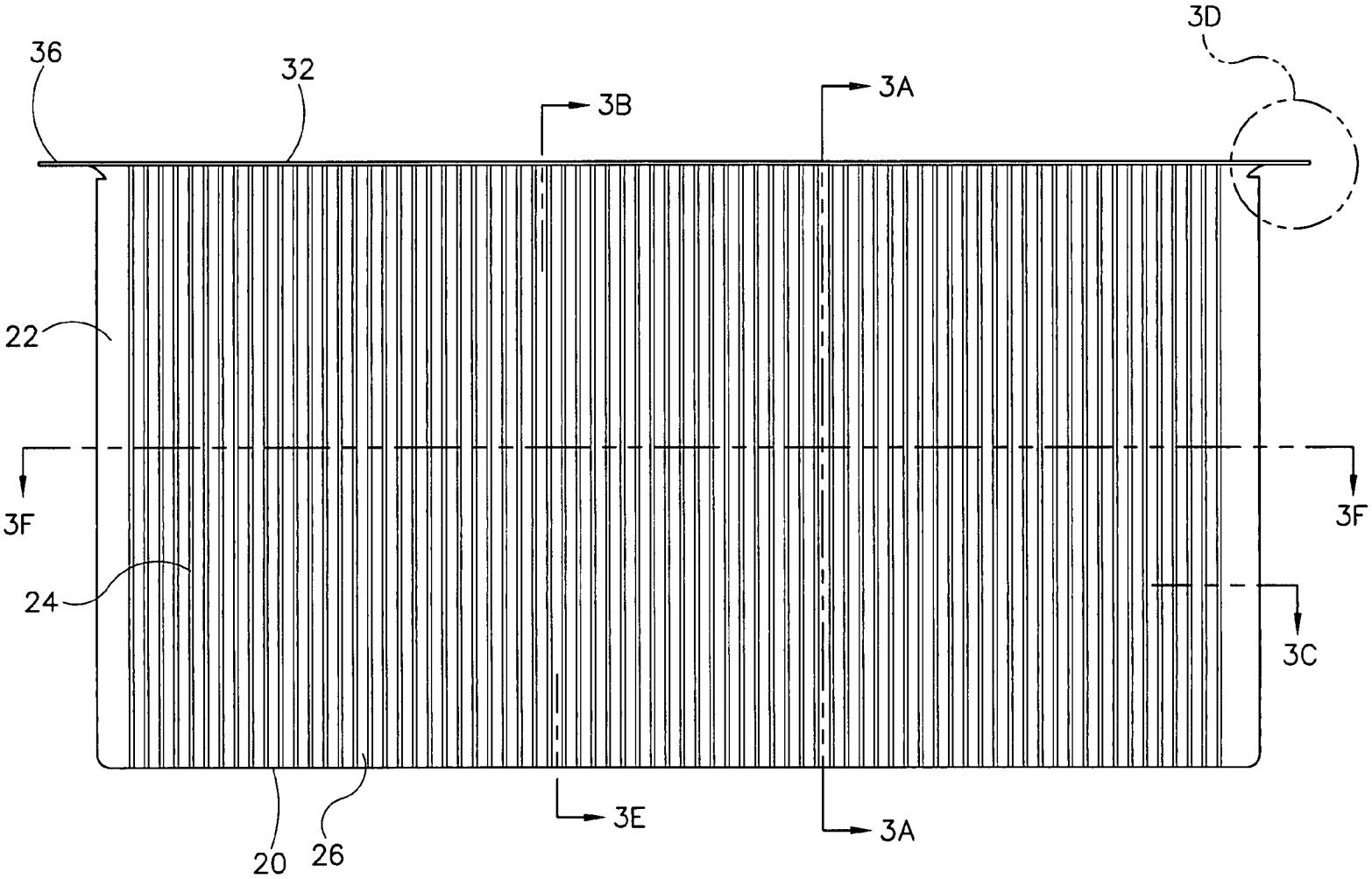
Figure 3I:
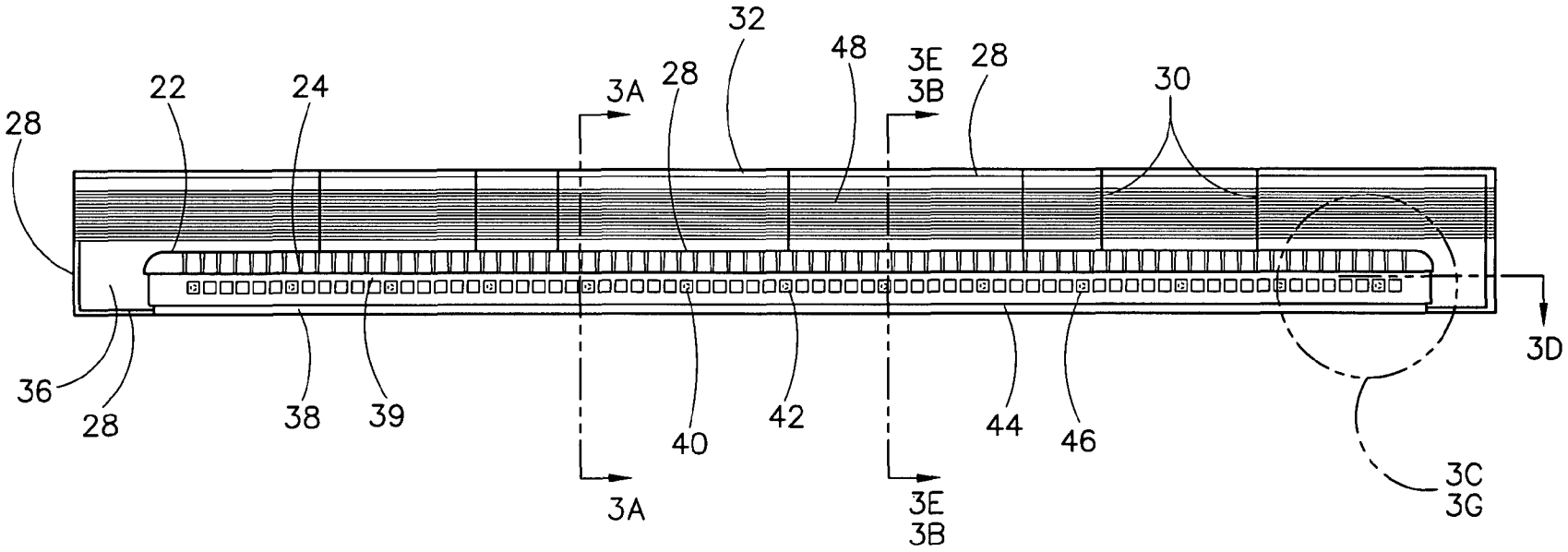
Figure 4:
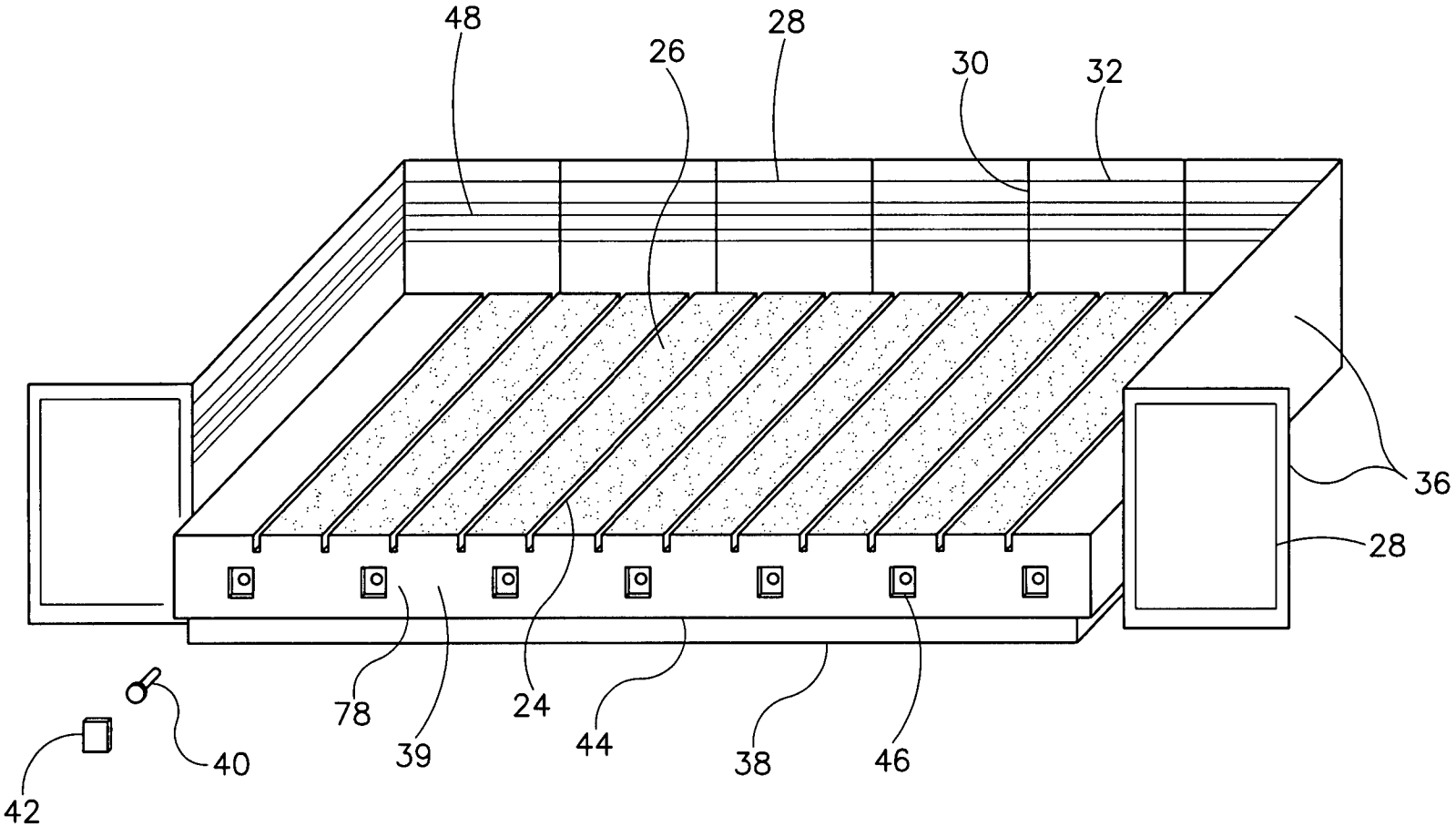
FIG. 4 illustrates a recessed deck, in accordance with one embodiment of the present invention.
Figure 5:
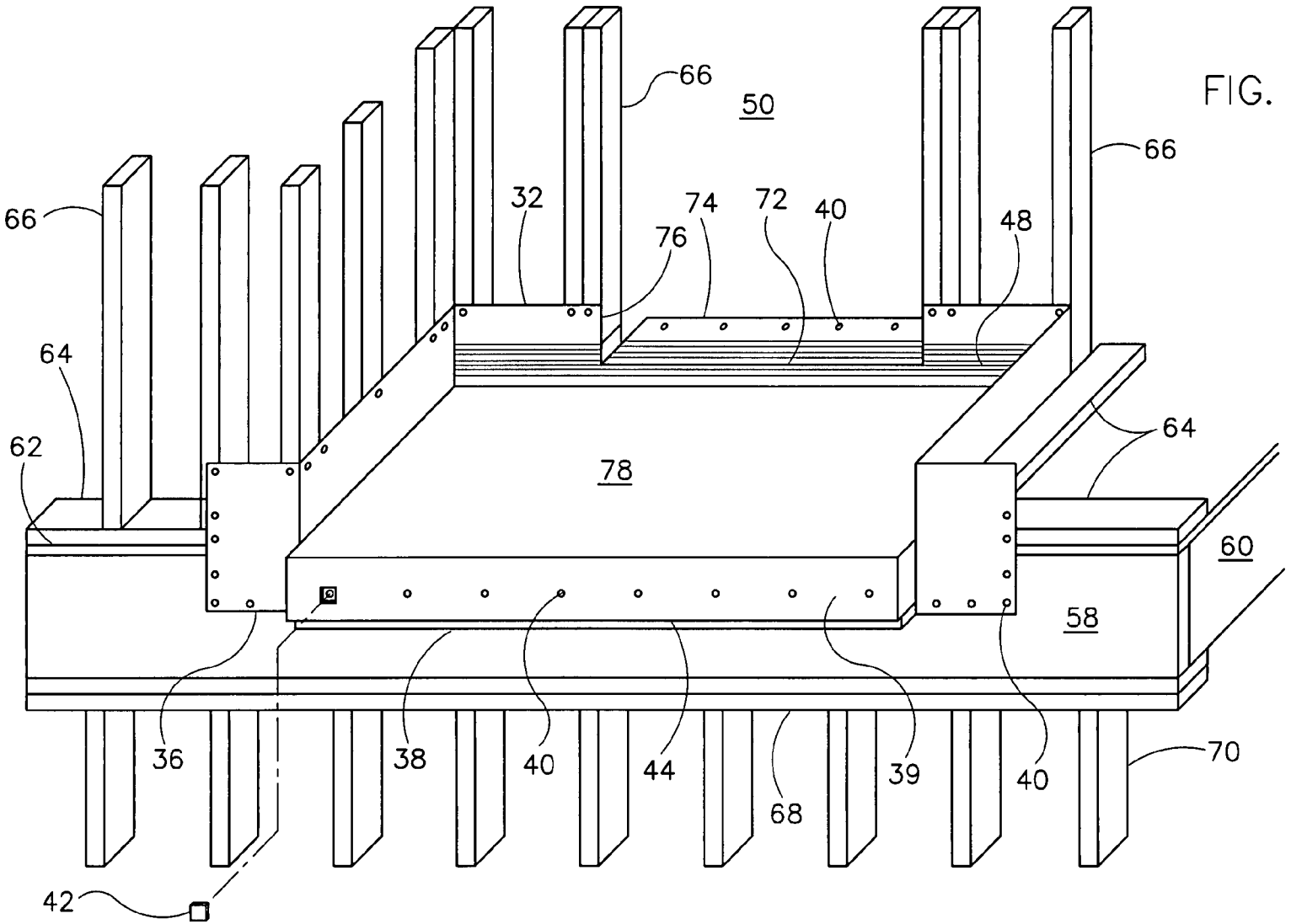
FIG. 5 illustrates a recessed deck attached to a building, in accordance with one embodiment of the present invention.

FIG. 2 shows the one-piece cantilever deck 20 floating directly above where it will be installed onto a typical wood framed house. We are looking down onto the wood framed second floor of a house under construction from the front right. Directly below the deck is the wood framed cantilever deck. Smaller floor joists 56 cantilever towards us supported by the stud wall 70, 68, below. The first floor studs 70 support the double top plates 68 above. The rim joist 58 of the second floor sits on the plates 68. Note that the deck plywood 52 is 2'-4' lower 72 than the second floor main level plywood 50.

Perpendicular to the rim 58 and sitting on the top plates 68 are the large second floor joists 60. Plywood 62 is nailed down on the joists 60 and the second floor wall is built. The sole plate 64 and the studs 66 are shown, as well as the opening 50 for the patio door. A cantilever deck is framed by extending the deck joists 56 out past the wall below and finished of with the deck rim joist 54. These joists 56 slope down about 2% away from the wall. Plywood 52 is nailed to the top of the joists 56 and the rim 54. Plywood sheathing and building paper will be placed on the studs later.

FIG. 3 shows the deck 20 installed on the wood framing. Building paper installed under the plastic deck is not shown for clarity. The front apron 39 and side aprons 49 are screwed using screw hole recesses 46 to the deck rim joist 54 and the deck joists 56. The back flashing 32 and side flashings 36 are screwed to second floor studs 66, sole plate 64 and rim joist 58. In the patio door opening 50, vertical cuts 76 are made in the back flashing 32 and the flashing is bent back 90 degrees along one of the bending grooves 48 and screwed down to the plywood 62.

The deck is ready for more building paper, the patio door, lathe and plaster and stucco. After the stucco is painted a guard rail can be installed directly to the top of the plastic deck, or to the deck wood framing below. Nothing else needs to be done to the plastic deck—no paint, no sealer, no surfacing. The decking can take on any number of colors, and the colors are added to the plastic as an additive, to produce the desired color shading.

In the case where the rain proof deck is recessed back into the second floor, the recessed deck 78 takes the form shown. Looking at the deck from the front right, we see the drainage grooves 24, which are also strengthening ribs, and the roughened walking surface 26. Along the front apron 39 are the screw hole recesses 46 where the screws 40 and screw plugs 42 are installed. The back flashing 32 and side flashings 36 bend up from the walking surface. The entire deck is formed from one sheet of plastic, so it installs as one unit, and thus prevents leaks (as there are not seams). No hot mop or asphalt felt is required below the deck since it itself is rain tight. On the vertical flashings are bending grooves 48, screw guide grooves 28 and vertical cut grooves 30. This design allows doors to be installed anywhere on the left, right or back of the deck. Bottom flashing and drip 38 allows for a gutter or wood trim to be installed.

Looking at the recessed deck 78 again from the front right, we see it installed in typical wood framing. Note that the level of the deck drops 2'-4' from the main second floor level 72. This helps keep blowing rain out of the house. Like we saw in FIG. 3, the first floor studs 70 support top plates 68 which support rim joist 58 and floor joists 60, which are taller than the deck joists (not shown). Plywood 62 covers the second floor and is under the deck. Sole plate 64, studs 66 and the patio door opening 50 are shown. The back flashing 32 is cut 76 at each side of the patio door opening 50 and bent back 74 along the bending grooves 48, and it is screwed 40 down to the plywood 62. The flashing are screwed to studs 66, plates 64 and rims 58. The front apron 39 is screwed 40 to the rim 58, finished with tapped in screw plug covers.

FIGS. 1 through 5 illustrated the deck in its one piece configuration. Some deck projects are so large that they cannot be produced in one piece due to the size of available sheet plastic, the size of delivery trucks or the ability of the crew to efficiently and safely handle the material.

Figure 6:
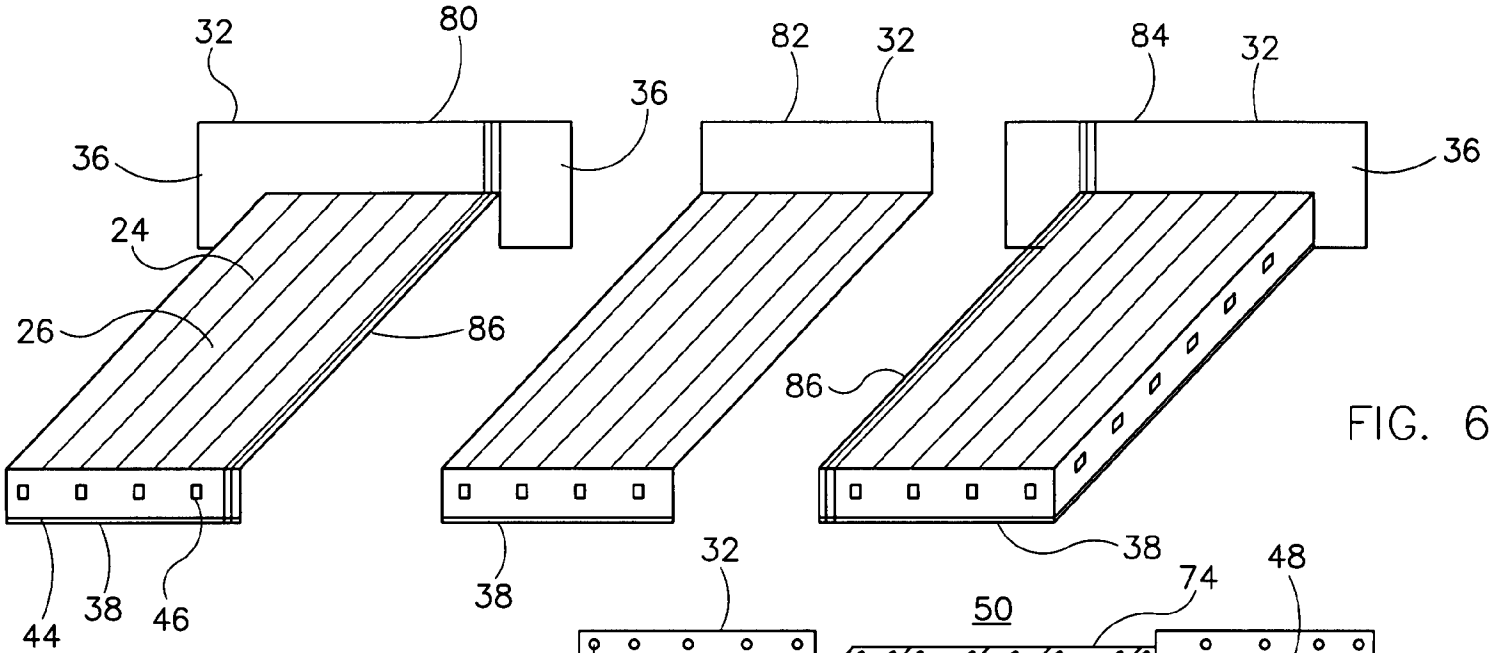
FIGS. 6 and 7 illustrate a multi-panel deck, in accordance with one embodiment of the present invention.
Figure 7:
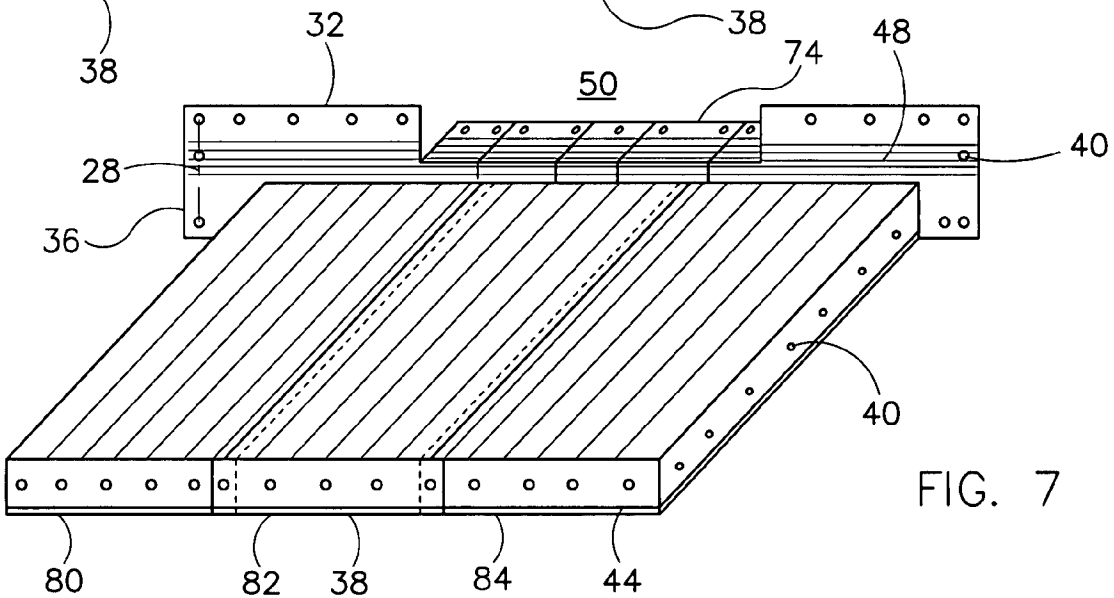

FIG. 6 shows a three piece deck system that when assembled and snapped together creates the watertight deck shown in FIG. 7. In FIG. 6 we see the roughened walking surface 26, the structural rib drainage grooves 24, and the side 36 and back flashing 32. FIG. 6 shows the three different pieces of the system: the left deck section 80, center deck section 82 and right deck section 84. Bottom flashing 38, drip 44 and screw hole recess 46 are shown. Special overlap snap grooves 86 are shown facing the center section 82 on the left 80 and right section 84.

FIG. 7 shows the three pieces assembled. The patio door opening 50 is shown with the cut section of the back flashing bent back 74 along a bending groove 48 and screwed 40 down Screws 40 are placed in the guide grooves 28 in the side 36 and back flashing 32. Together, the three pieces can create a large deck that is completely water tight and three times bigger that the one piece deck. Of course, the size will depend on the application and the number of decks that are combined to form a large deck. In some commercial applications, the number of joined decks can be many, while in smaller residential projects a single deck will be sufficient.

The one piece awning is very similar to the one piece deck. The main surface slopes steeper like a roof, it has ribs 88 for strength and drainage grooves 24, but it needs no wood structural support under it. It gains its strength from the triangular shape, the ribs and the screws 40 holding the side 36 and back flashings 32 to the structural wall. The flashing has structural ribs 88 which transfers loads to the screws 40. It is intended to be installed over doors or windows for sun or rain protection. Since the flashings go under the stucco or siding, it is intended for new construction. But, it can also be used in remodels if appropriate adjustments are made.

Figure 10:
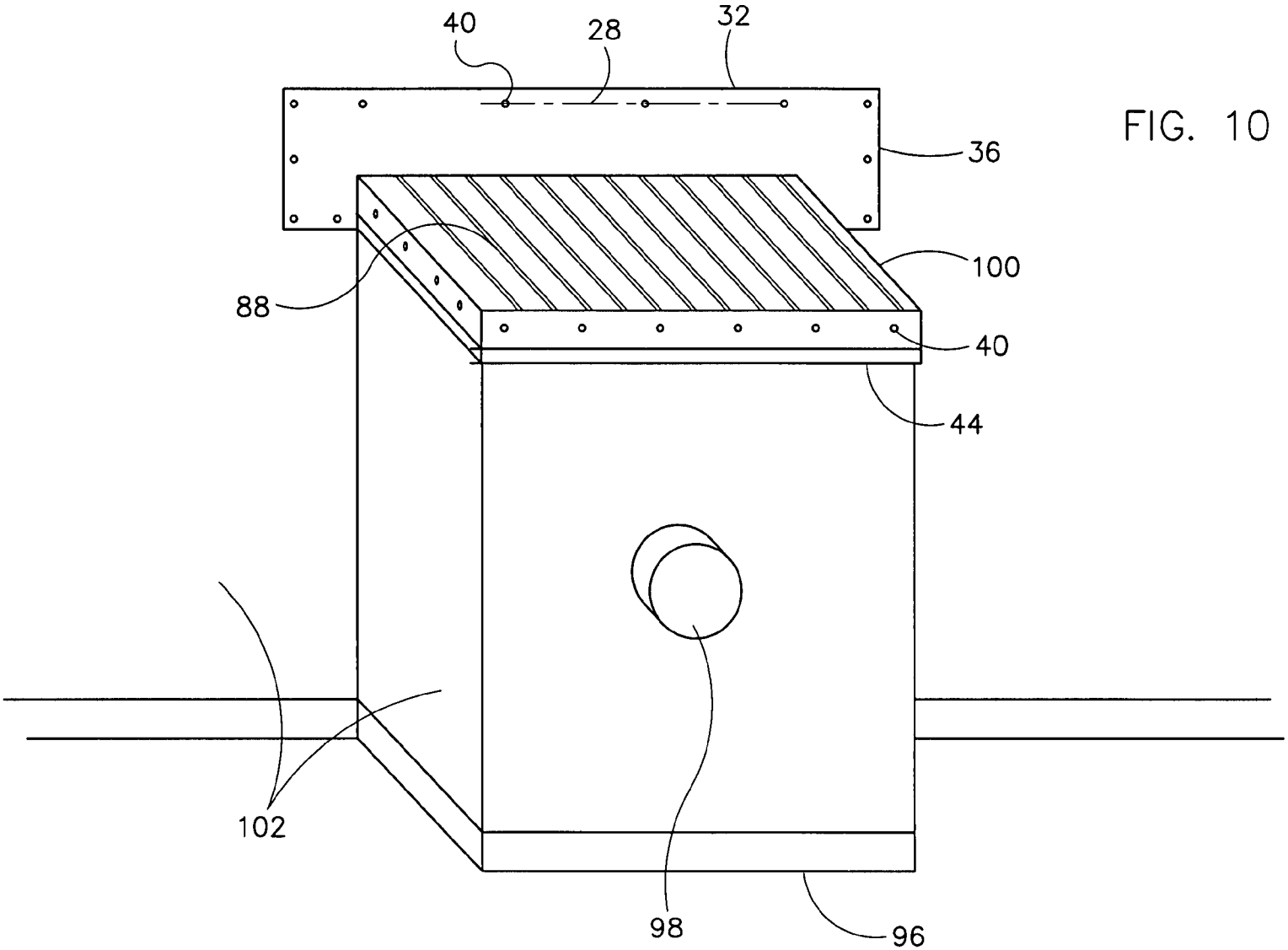
FIG. 10 illustrates a fireplace roof and integral flashing, in accordance with one embodiment of the present invention.
Figure 11:
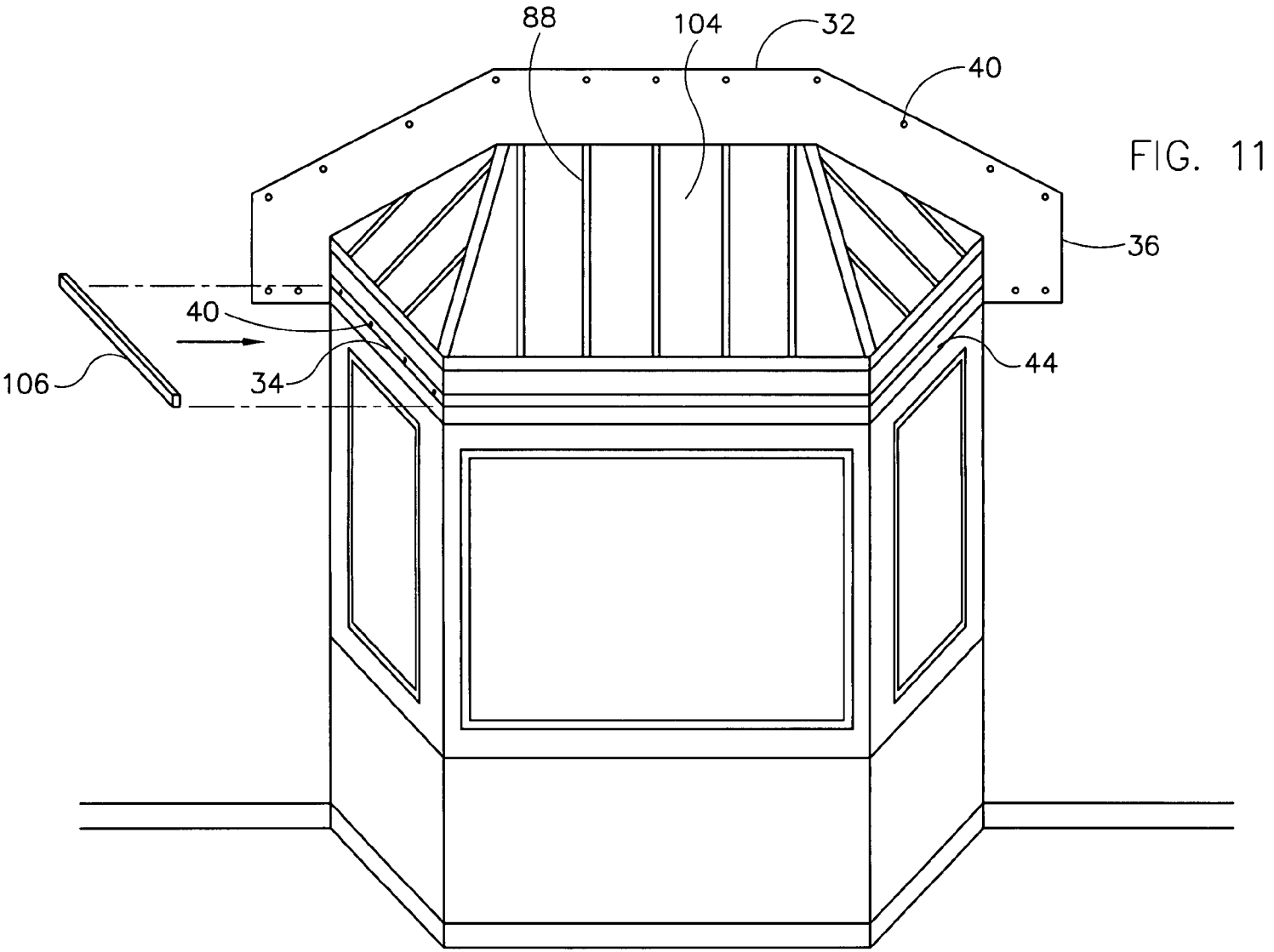
FIG. 11 illustrates a bay window roof with integral flashing, in accordance with one embodiment of the present invention.
Figure 12:
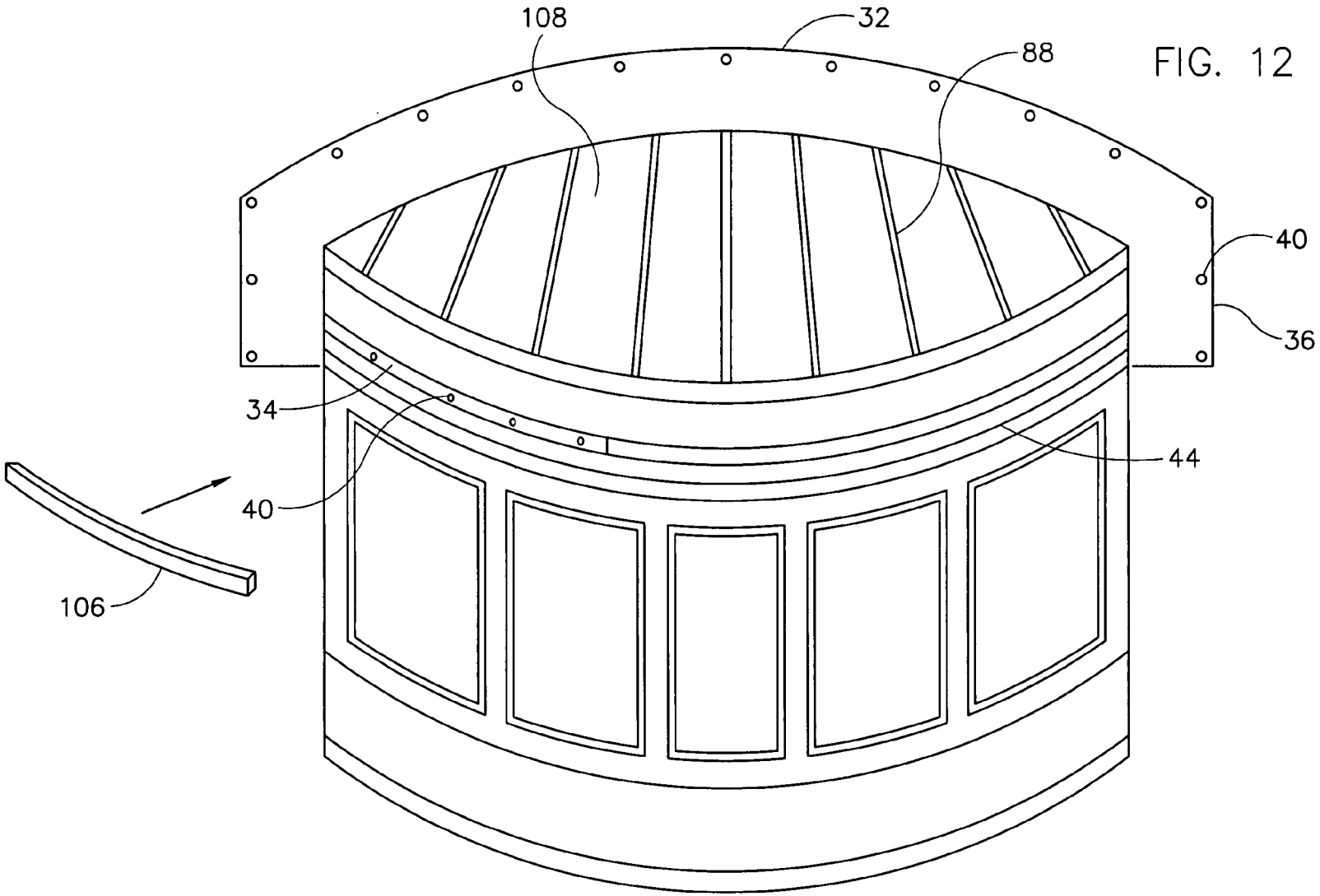
FIG. 12 illustrates a bow window roof with integral flashing, in accordance with one embodiment of the present invention.

FIG. 9 shows the optional built-in gutter 92, which includes a hole to which a down spout can be attached. FIG. 10 provides the detailed illustration of a direct vent gas fireplace roof. The use of a direct vent fireplace is becoming more popular as municipalities are required to reduce pollution, and thus restrict the use of traditional wood burning fireplaces. Direct vent gas-only fireplaces are increasing sold with the gas vent going sideways straight out the back of the firebox. The traditional boxes are projecting into the side setbacks, but the chimneys are eliminated. As something has to cover the 2'×5' projection so architects have been specifying matching composition or tile roof, or galvanized metal flashing. FIG. 10 shows the DV Fireplace Roof 100 installed over the box 96 with the side vent 98. The back and side flashing 32 36 are attached with screws 40 though the screw grooves 28. The top of the roof has structural ribs 88 and a drip 44 around the front and side aprons.

There are many smaller projections in residential construction like bay and bow windows that can use rain proof preformed roof and flashing systems. Installing the plastic molded bay and bow window roofs save a lot of time and money. No rafters or plywood are needed, and the structural ribs 88 keep the roof 104 from sagging. Screw 40 the flashing 32 36 and apron on, then snap the strip screw cover 106 into the screw channel 34, and you are done.

Figure 13:
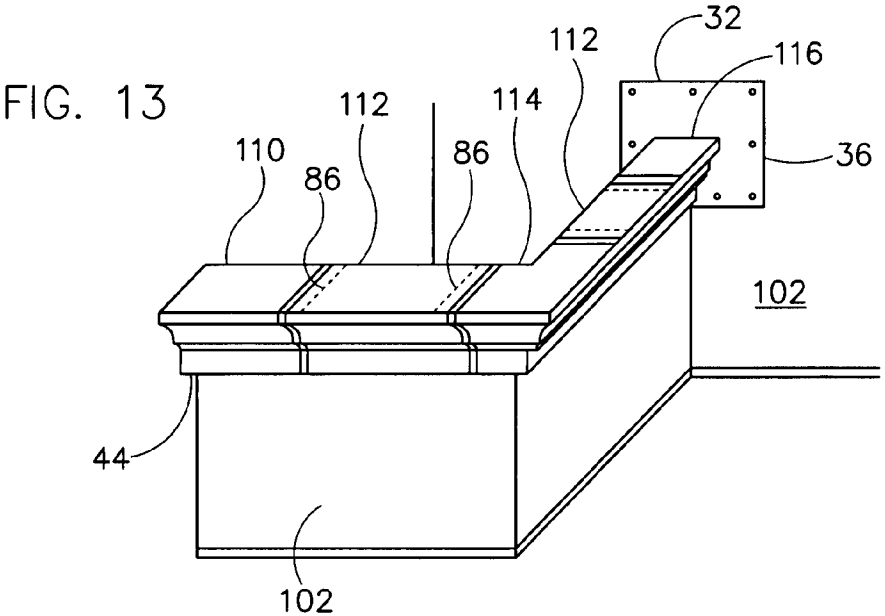

FIG. 13 shows a parapet or free-standing stucco wall 102. Too often no cap at all is placed on a stucco wall, only to discover years later that water has leaked down the wall through small crack in the stucco on the top of the wall. A metal cap is a better solution, but is not attractive if in a visible location such as a 36' high stucco wall around a deck. FIG. 13 shows one piece plastic decorative caps that interlock with adjacent caps, maintaining the water seal even at the joints 86. Four caps are offered: the end cap 110, straight run 112, 90 degree corner 114, and end cap terminating into a wall 116 integral with top 32 and side flashing 36. In this embodiment, all pieces have drips 44.

Figure 14:
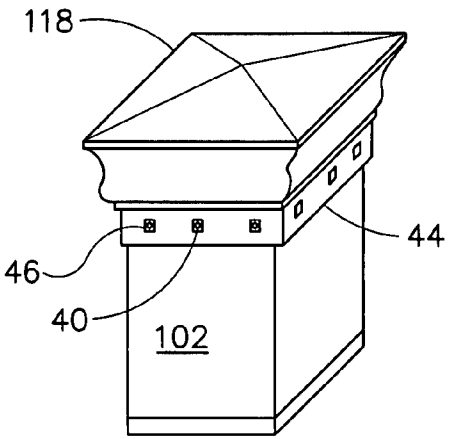
FIGS. 13-19 illustrate additional applications of a plastic molded structure for use in building construction, in accordance with one embodiment of the present invention.
Figure 15:
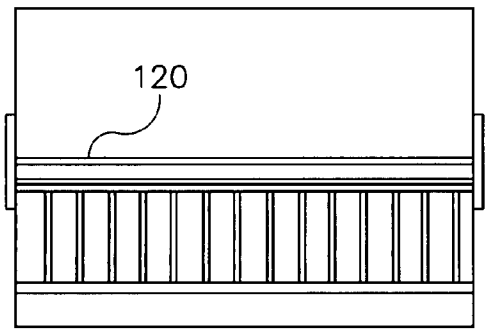

FIG. 14 is a one piece cap 118 for pilasters 102 such as pilasters that support entry gates. Screws 40 are installed into screw recesses 46 and covered with screw caps. Drip 44 accepts trim or stucco. FIG. 15 shows a railing cap 120 designed to work with the recessed deck of FIGS. 4 and 5.

Figure 16:
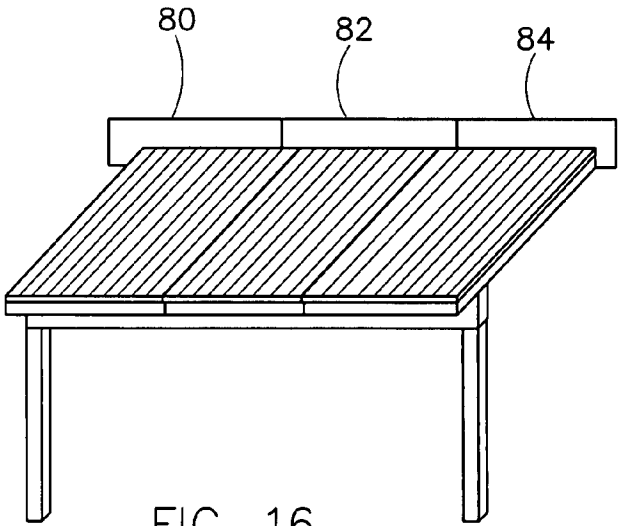

FIG. 16 shows a patio cover. Similar to the 3 piece deck, the 3 piece Patio Cover spans the full length from wall to beam without any rafters or plywood, just with the strength of the ribs.

Figure 17:
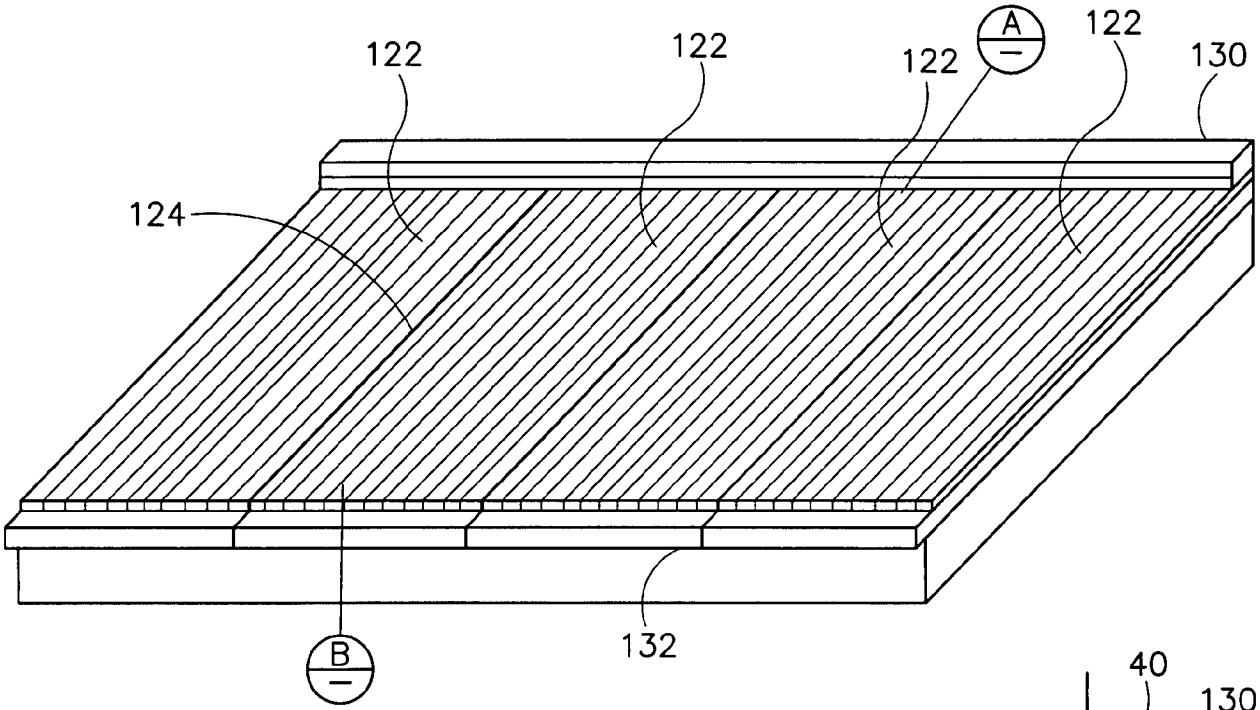
Figure 19:
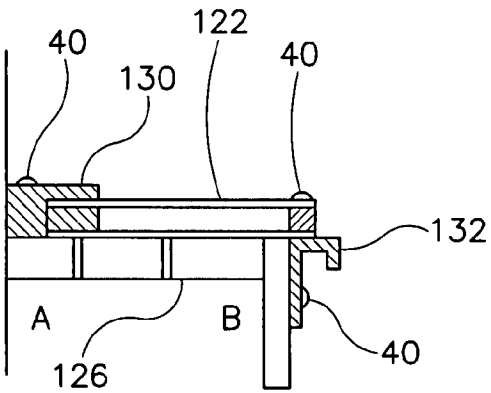
Figure 18:
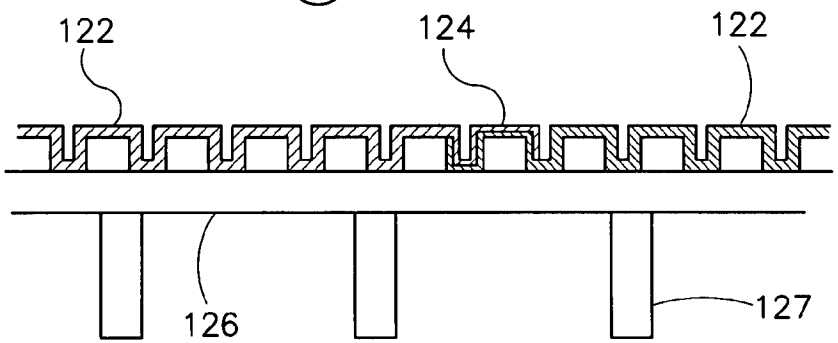

FIGS. 17, 18 and 19 illustrate a retro-deck. The retro-deck is designed to go over any size or shape existing redwood deck. Although not 100% watertight, retro-deck is a big improvement in keeping rain out from under the deck, it prevents further rotting of the joists and looks new and clean. All sections 122 are the same and they snap together at the long edges 124. The top edges at the house side of the deck are finished with head stop 130, and the front edge is contained by base stop 132 which has an integral drip. Stops are screwed down 40 to the existing decking 126 and joists 127.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims. In the claims, elements and/or steps do not imply any particular order of operation, unless explicitly stated in the claims.

What is claimed is:

1. A structure for use in building construction, comprising:

a body having a top surface, a bottom surface, and side surfaces, the top surface being a walking surface that defines a deck; and a flashing liner being integrally formed with the body, the flashing liner being defined at one or more of the side surfaces of the body for interfacing with a door of a building structure;

wherein the body is defined for attachment to the building structure at a location of the door to define a connection between the building and the walking surface of the deck that is outdoor of the building, and the flashing liner providing a weather interface with the building structure.

2. A structure for using in building construction as recited in claim 1, wherein the body and the flashing liner are defined from a single molded material piece.

3. A structure for using in building construction as recited in claim 2, wherein the single molded material piece is defined from plastic.

4. A structure for using in building construction as recited in claim 3, wherein the plastic is selected from the group consisting of one or a combination of (a) polyethylene, (b) olefin (c) olefin fibers (d) polypropylene and polyethylene, (e) polystyrene, (f) poly (vinyl chloride), and (g) polytetrafluoroethylene.

5. A structure for using in building construction as recited in claim 2, wherein the single molded material piece is plastic that is form molded, or injected molded, or pressure molded, or vacuum molded.

6. A structure for using in building construction as recited in claim 1, wherein the top surface has a plurality of grooves.

7. A structure for using in building construction as recited in claim 1, wherein the side surfaces of the body include screw hole recesses for attaching the body to the building structure, and wherein the top surface excludes screw hole recesses.

8. A structure for using in building construction as recited in claim 1, wherein the flashing liner includes screw guide grooves and vertical cut guides.

9. A structure for using in building construction as recited in claim 6, wherein the deck defines a cantilever from the building structure or a recessed structure within the building structure.

10. A structure for using in building construction as recited in claim 6, wherein the side surfaces include bottom flashing that is integrally formed with the body.

11. A deck structure to be attached to a building, comprising:

the deck structure having a grooved top surface, a bottom surface, and side surfaces, the deck structure being defined from a plastic mold, the grooved top surface being a walking surface of the deck structure; and a flashing liner being integrally formed from the plastic mold along with the deck structure, the flashing liner and the deck structure defining a unitary structure without connecting seams, and the flashing liner being defined at one or more of the side surfaces of the deck structure, the flashing liner defining an interface with a door of the building;

wherein the body is capable of being attached to the building at a location of the door of the building to define a connection between the building and the walking surface of the deck structure that is outdoor of the building, the flashing liner providing a weather interface with the building and the walking surface providing a supporting interface for human support and traverse when the deck structure is attached to the building, wherein the deck structure defines a cantilever from the building or a recessed structure within the building.

12. A deck structure to be attached to a building as recited in claim 11, wherein the plastic is selected from the group consisting of one or a combination of (a) polyethylene, (b) olefin (c) olefin fibers (d) polypropylene and polyethylene, (e) polystyrene, (f) poly (vinyl chloride), or (g) polytetrafluoroethylene.

13. A deck structure to be attached to a building as recited in claim 11, wherein the deck structure and the flashing liner is defined from a molded material piece of plastic that is form molded, or injected molded, or pressure molded, or vacuum molded.

14. A deck structure to be attached to a building as recited in claim 13, wherein the side surfaces of the deck structure include screw hole recesses for attaching the deck structure to the building, and wherein the top surface excludes screw hole recesses.

15. A deck structure to be attached to a building as recited in claim 11, wherein the flashing liner includes screw guide grooves and vertical cut guides.

16. A deck structure to be attached to a building as recited in claim 11, wherein the side surfaces include bottom flashing that is integrally formed with the deck structure.

17. A deck, comprising:

the deck having a rough top surface, a bottom surface, and side surfaces, the deck structure being defined from a plastic mold, the rough top surface being a walking surface that defines the deck; and a flashing liner being integrally formed from the plastic mold along with the deck, the flashing liner and the deck defining a unitary structure without connecting seams, and the flashing liner being defined at one or more of the side surfaces of the deck, the flashing liner being configured as an interface with a building at one of a wall or a door way of the building so that the flashing liner defines a connection between the building and the walking surface of the deck when the deck is attached to the building, the flashing liner establishing a weather tight interface between the wall or the door way of the building, the rough top surface that defines the walking surface has grooves defined by the plastic mold, the grooves extending substantially perpendicularly away from the building, such that the grooves drive water away from the building, when the deck is attached to the building.

18. A deck as recited in claim 17, wherein the rough top surface defines a human supporting surface.

19. A deck as recited in claim 17, wherein the flashing liner includes screw guide grooves and vertical cut guides.

* * * * *